United States Patent [19]

Rozmus

[11] 4,162,572

[45] Jul. 31, 1979

[54] PROVIDING SOLDER ON ELECTRICAL CONTACTS

[76] Inventor: John J. Rozmus, 1030 Derwydd La., Berwyn, Pa. 19312

[21] Appl. No.: 848,803

[22] Filed: Nov. 7, 1977

[51] Int. Cl.[2] ..... H01R 9/00

[52] U.S. Cl. ..... 29/630 D; 228/255

[58] Field of Search ..... 29/630 R, 630 C, 630 D; 228/255, 253, 245

[56] References Cited

U.S. PATENT DOCUMENTS

| | | | |
|---|---|---|---|
| 3,750,265 | 8/1973 | Cushman | 29/471.3 |
| 3,886,650 | 6/1975 | Cobaugh | 228/136 |
| 3,919,760 | 11/1975 | Roders | 228/14 |
| 3,978,569 | 9/1976 | Cobaugh | 29/203 |
| 3,990,864 | 11/1976 | Rozmus | 29/630 C |

*Primary Examiner*—Lowell A. Larson
*Assistant Examiner*—C. J. Arbes
*Attorney, Agent, or Firm*—Frederick J. Olsson

[57] ABSTRACT

Providing solder on electrical spring contacts being stamped in a press by arranging the press to form a mounting section on the contact, position a segment of solder adjacent the mounting section, cut the segment, and then wrap the same over the mounting section.

5 Claims, 6 Drawing Figures

PROVIDING SOLDER ON ELECTRICAL CONTACTS

This invention relates to electrical contacts made on high speed, automatic stamping machines and in particular relates to a method for providing solder on the contact at the same time the contact is being formed.

When mounting electrical contacts on devices such as printed circuit boards, plug connectors and the like it is, in many instances, highly desirable from the standpoint of electrical and mechanical integrity to provide a solder connection between the contacts and the mounting means or base of the device.

Conventional techniques for applying solder include (a) stamping the contacts in a press, inserting the contacts in a mounting base and then manually applying solder to each individual contact at the area where the same joins the base; (b) stamping the contacts in a press and then manually placing a solder pre-form on each individual contact; (c) stamping the contacts in a press and then depositing or plating a solder mass on each individual contact; (d) stamping a strip to partially form the contacts and winding the strip up in a roll, feeding the roll to a wave solder machine which applys solder to a selective area on each contact and winding the composite in a roll and subsequently feeding the roll of composite to a press to complete the stamping operation.

It is self evident that the conventional techniques are highly disadvantageous because of the economics of the handling problem imposed by multiple, separate operations as between stamping the contact and applying the solder. Moreover, these methods have a quality control problem with respect to the precise amount of solder to be applied and the position where it is to be located.

The present invention contemplates attaching the solder while the contact is being stamped out so that each contact is finished with the solder attached. This eliminates handling and provides the precise amount of solder at the desired location.

Prior U.S. patents showing electrical contacts or conductors having a descrete solder mass are noted following: U.S. Pat. Nos. 3,083,350; 3,324,230; 3,351,704; 3,744,129; 3,780,433; 3,849,870; 3,886,650; 3,905,665; 3,915,546; 3,978,569; and 3,997,237.

The invention will be explained below in connection with the following drawings wherein.

Figure 6:
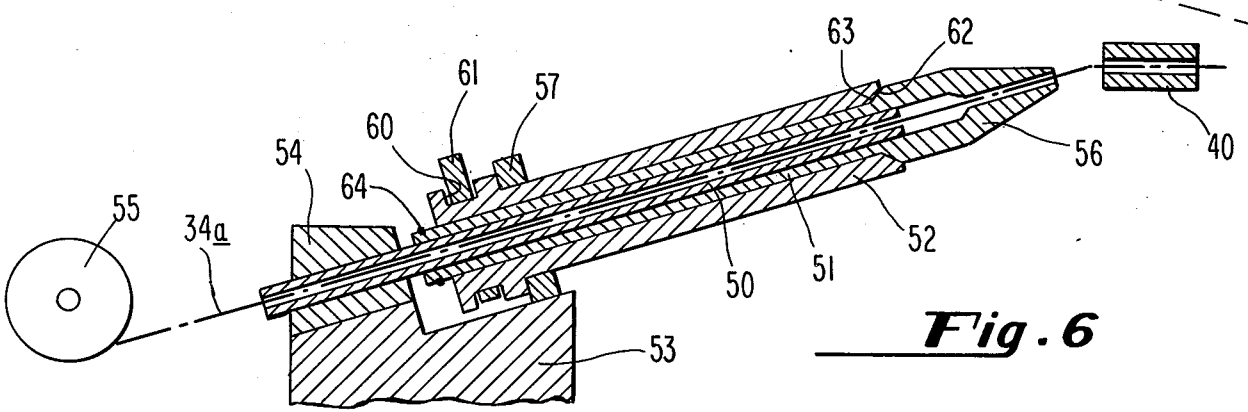
Figure 4:
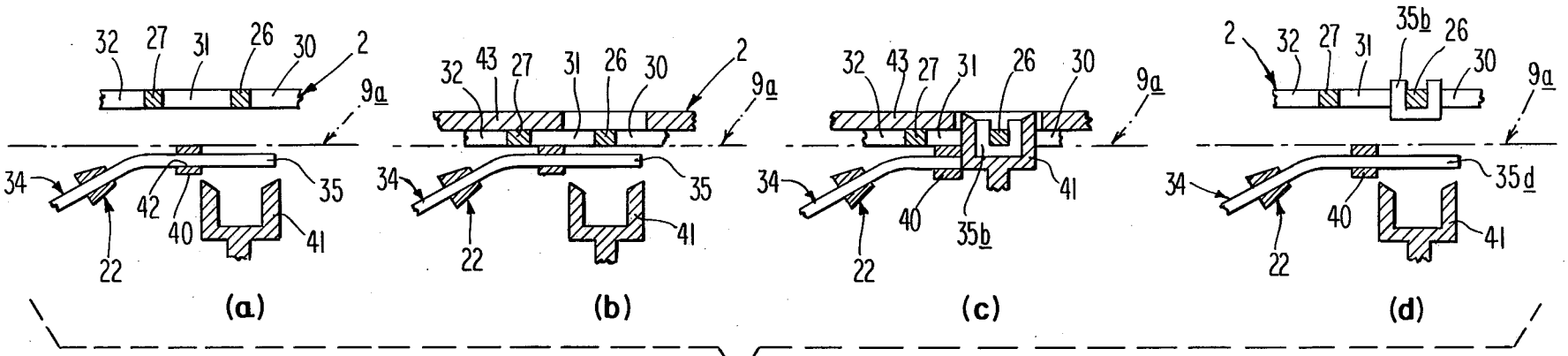
Figure 5:
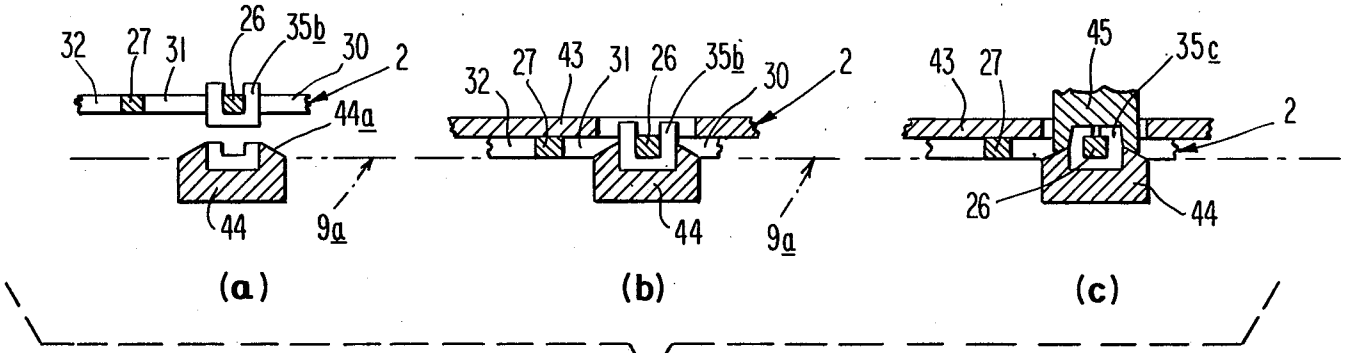

FIG. 4 parts (a) through (d) illustrate the working of tools used for positioning, cutting and wrapping the solder;

FIG. 5, parts (a), (b) and (c) illustrate the working of tools used for further wrapping the solder; and FIG. 6 is a sectional elevational view illustrating a device for incrementally feeding the solder.

Before proceeding it is pointed out that the drawings are diagrammatic and various of the parts are not shown in precise proportional size. It will be understood that this is done for purposes of illustrating the best mode and the principles involved in the functioning, operation, and manipulation of the parts and additionally because form and size are not critical, per se.

Figures 1, 2:
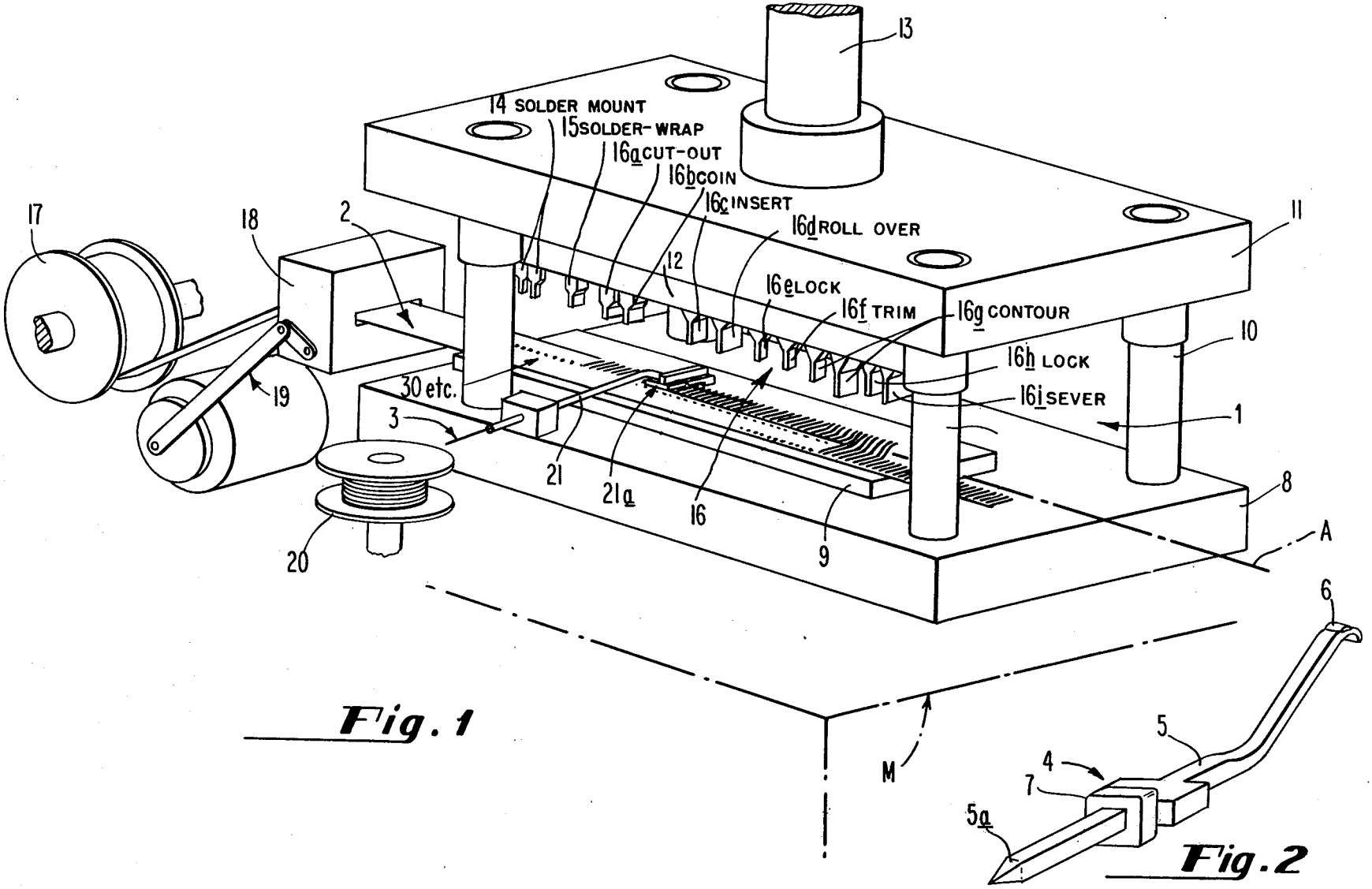
FIG. 1 is a perspective view of a press to stamp out electrical spring contacts and incorporating the means for practicing the invention.
FIG. 2 is a perspective view of a typical electrical spring contact provided with a solder band.

By way of example, the press or stamping machine M of FIG. 1 is set up to fabricate and attach solder to electrical spring contacts generally of the kind shown in my U.S. Pat. No. 3,990,864. However, it will be understood that the invention is applicable to other types and forms of electrical contacts. The operation of the press in fabricating the contacts will be commented on below but details of same may be had by reference to said patent.

The press M incorporates a progressive die 1 arranged to receive and work a body strip 2, a surface strip 3 and a solder strip (not shown in FIG. 1) which intermittently move (left to right) through the die along the axis A where they are joined and stamped into electrical contacts each having a solder band. Typical of such contacts is a contact 4 diagrammatically illustrated in FIG. 2 which comprises contact body 5, and a precious metal contact element 6 together with a solder band 7 on the shank 5*a*.

The progessive die 1 has die bolster 8 which is fixedly mounted on the press and carries the die pad 9. The guide pins 10 extend up from the die bolster and carry a punch pad bolster 11 which mounts the punch pad 12. The punch pad bolster 11 is adapted to be moved on the pins 10 toward and away from the die bolster 8 as by the drive means noted at 13.

The punch pad bolster 11 carries solder punch means or tools 14 and 15 and fabricating punches or tools 16 (identified as 16*a* through 16*i*). The die pad 9 carries corresponding dies or tools which for the sake of clarity are not shown. The respective mating punches and dies are spaced respectively at fabricating and solder stations along the axis A. Stripper plates and stock guides guide the strips 2 and 3 along the axis A and maintain the strips against lateral movements. A spring stripper is used in the area where the solder is attached. For the sake of clarity, the foregoing elements are not shown in FIG. 1.

The body strip 2 is mounted on a roll 17 and is pulled off the roll and intermittently fed along the axis A by the feeder 18 operated by the motor mechanism 19.

The intermittent motion of the feeder 18 is coordinated with reciprocating motion of the press drive 13 so that the punch pad bolster moves down and the punches contact the strips during dwell periods.

The surface strip 3 is mounted on the roll 20 and is conducted into position by the guide 21 which directs the strip into the funnel mechanism 21*a* mounted over the body strip 2 from which it is joined to the body strip and is indexed along with the same.

The solder strip is mounted on a spool from which it is intermittently taken off by a feed mechanism 22 (see FIG. 4) as explained later.

Before commenting on the solder punches 14 and 15, brief mention is made of the fabricating punches 16*a* through 16*i* and their corresponding dies which work the strip after the solder is in place. The elements work the strips as follows: 16*a* makes cut-outs in the body strip to form a contact body; 16*b* coins a transverse slot in the contact body; 16*c* inserts the surface strip 3 in the slot; 16*d* and 16*e* push metal of the body strip over the surface so the same is locked in position; 16*f* trims or cuts off the surface strip on either side of the slot, 16*g* contours the contact body; 16*h* further works the metal on the surface strip; and 16*i* severs the contact from the strip 2. The details of the foregoing may be had by reference to my U.S. Pat. No. 3,990,864.

The solder punches 14 and 15 and their corresponding dies or tools are incorporated in the progressive die and spaced along the axis A and configured and movable to secure the correct amount of solder in the correct position on the contact. A typical arrangement for the foregoing will now be discussed.

The invention contemplates attaching the solder prior to the final fabricating step, i.e., the step of severing the contact from the body strip. In this sense, the solder is incorporated in at least a partially formed contact. The reason for this is that once the contact is severed it drops away from the press and to attach solder at this point would involve objectionable handling. For the particular contact used as an illustration, the solder is attached prior to the time the body strip is worked by the fabricating punches 16. This is done for the sake of convenience. It will be understood that other types of contacts may dictate the attachment of the solder at other points in the stamping operation.

With the above in mind then, the punches 14 and 15 are set up ahead of the punches 16 (see FIG. 1) and provide a mounting section for each contact to be punched out. The mounting section receives the solder. The forming of the solder mounting section and the attachment of the solder thereto will be explained in connection with FIG. 3.

Figure 3:
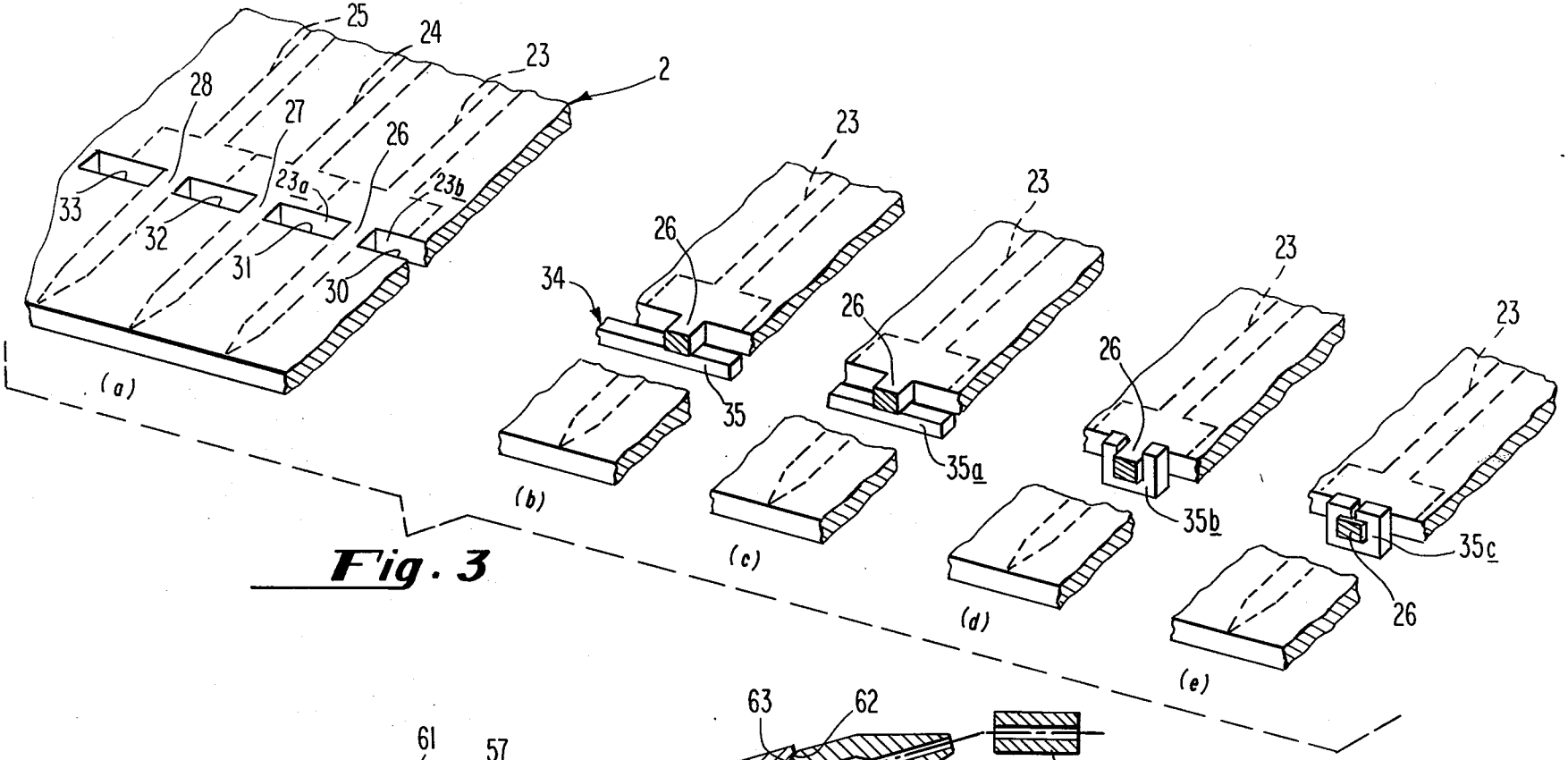
FIG. 3 is a perspective view wherein parts (a) through (e) illustrate how solder is secured to the contact during the stamping of the same.

In FIG. 3, part (a) I have shown a small segment of the body strip 2 and in parts (b), (c), (d) and (e) have illustrated the solder being attached. In part (a) the dotted lines 23, 24 and 25 each outline portions of the contacts which will be formed by the fabricating punches 16.

The first step in the process of attaching the solder is the forming of the solder mounting section. This is illustrated in part (a) where the mounting sections are noted at 26, 27 and 28. The sections are formed as by the punches 14 punching out holes 30, 31, 32 and 33. It will be evident that the punching of holes 30, etc., partially forms the contacts. For example, with respect to the contact 23, the mounting section 26 and the shoulders 23*a* and 23*b* remain an integral part of the finished contact.

The mounting section is the inner part of the shank 5*a* and as such is simply one portion of the contact as it would normally be formed. In the other contacts, the mounting section may be one portion of the contact as would normally be formed but having a special configuration or in other contacts the mounting section may be formed as an addition to the normal contact structure.

For purposes of illustrating the solder attachment, I have represented in parts (b), (c), (d) and (e) a portion of the strip from which the contact 23 will be formed.

The next step in the process is the positioning of a segment of solder strip adjacent the mounting section. This is illustrated in part (b) where the solder strip 34 has a segment 35 positioned adjacent and below the mounting section 26. The segment 35 is positioned during the time the die bolster is moving upwardly on the return stroke. The positioning means is illustrated in FIG. 6 and partially in FIG. 4 part (a) and will be commented on later.

It is to be observed that in the drawings I have shown the solder to be generally rectangular in cross section. This has been done for simplicity of illustration. Conventionally solder strip is produced with a circular cross section.

After the segment 35 has been positioned, the solder strip is sheared so that correct length of solder is ready to be attached to the mounting section. The cut solder is illustrated in FIG. 3 part (c) at 35*a*. The amount of solder to be applied can be controlled by the cross section of the strip and the length of the cut segment.

After cutting the appropriate length of segment, the cut portion 35*a* is wrapped over the mounting section as noted in FIG. 3 part (d) at 35*b*. The solder 35*b* tightly grips the mounting section and to some degree flows over the top of the same. In any event, the solder secured itself to the mounting section so that it stays in position as the strip is indexed.

After the solder is partially wrapped the next step causes the solder to flow over or be substantially wrapped on the mounting section as noted at 35*c* in FIG. 3 part (e). In the latter case the free ends of the solder either abut or are close together.

I have shown the operations of FIG. 3, parts (b), (c) and (d) as occuring at separated stations. This has been done simply for illustrative purposes. Actually, it is expedient that the placing of the solder segment 35 as in FIG. 3 part (b) and the cutting and wrapping as in parts (c) and (d) take place at the same station. The wrap-around operation of part (e) takes place at the next station after the body strip has been indexed. The foregoing will be explained in the matter appearing below.

Typical tooling incorporated in the progressive die and configured and movable for accomplishing the above will next be discussed in connection with FIGS. 4, 5 and 6.

Before proceeding with this, however, the manipulation of the body strip in the solder area will be discussed.

The particular tooling for cutting and wrapping the solder commented on below is of the nature that a spring stripper plate and spring lift cams are employed. These are conventional items used in die work. The cams are spring mounted in the die pad and function to lift or tilt the body strip slightly off the die pad surface. The stripper plate is spring mounted on the punch pad bolster so that on the working stroke the plate first contacts the body strip and the force causes the cams to yield and the plate pushes the strip down firm against the surface of the die pad. As the punch pad continues coming down the punches engage and work the strip.

Referring to FIG. 4 part (a) the punch pad bolster is in the up or return position. The top of the die pad 9 is represented by 9*a*. The body strip 2 is spaced away from the die pad surface by the lift cams not shown.

The die pad 9 carries an inset or guide 40. The die bolster 8 supports a tool 41 for reciprocating up and down motion. The die pad 9 has an opening to accommodate tool motion. The tool motion is synchronized with the motion of the punch pad bolster by rocker mechanism pivotally connected to the die bolster 8 with one end bearing on the bottom of the die or tool 41 and the other end bearing on a pin connected to the punch pad bolster 11. A spring between the die bolster 8 and the tool 41 acts to bias the tool 41 in a downward direction.

When the punch pad bolster 11 moves in the working stroke the pin moves down and rotates the rocker to cause the tool 41 to move up. When the punch pad bolster moves for the return stroke, the bias spring on the tool 41 operates to rotate the rocker in the opposite direction so that the tool 41 is moved down while the rod is moving up.

The insert or guide 40 and the solder feed mechanism 22 are positioned so that the solder strip 34 is fed thru the passageway 42 of the guide and out under the mounting section 26 and over the tool 41. As will be noted later, this feed takes place as the punch pad bolster is moving up on the return stroke.

The cutting and wrapping operation will be discussed in connection with parts (b) and (c) of FIG. 4. This takes place when the punch pad bolster 11 moves down in the working stroke. In part (b) of FIG. 4, the punch pad bolster has reached a position in the working stroke so that spring stripper plate 43 has contacted and pushed the strip 2 down against the die pad surface 9*a*. With further down motion of the punch pad bolster, the tool 41 is moved upwardly to first cut the segment 35 and then carry the cut segment up to engage the same with the mounting section 26 and upon continued upward motion deforms and wraps the segment over the mounting section as is indicated at 35*b* in part (c). As previously mentioned, the deformation and gripping force results in the solder securing itself to the mounting section.

When the punch pad bolster goes into the return stroke, the stripper 43 disengages and moves away from the body strip 2. The cams function to lift the strip away from the die pad. The tool 41 moves down and away from the solder 35*b* attached to the mounting section 26. The next segment of solder 35*d* is placed in position by feeder 22. the foregoing is indicated in FIG. 4 part d.

With reference to FIG. 4 part (d) it is pointed out that the strip 2 has been lifted to an extend that the bottom of the solder 35*b* is clear of the die pad surface to 9*a*. If the strip were not lifted away, the bottom of the solder would remain in the opening in the die pad and such a condition could strip the solder upon indexing and/or interfere with the indexing operation.

The strip with solder attached in now ready to be indexed to the next station to complete wrap over operation of FIG. 3 part (e). The tooling for this is illustrated in FIG. 5 parts (a), (b) and (c).

Referring to FIG. 5 part (a) the die pad bolster fixedly mounts a cradle 44, the top 44*a* of which extends somewhat the die pad surface 9*a*. As noted, the strip 2 has been indexed so that the mounting section 26 and the solder 35*b* are positioned just above the cradle. The raised position of strip 2 provides for the bottom of the solder 35*b* to clear the top 44*a* when the strip is indexed. The punch pad bolster is in the return position.

In FIG. 5 part (b) the punch pad bolster has moved down in the working stroke so that the stripper 43 has engaged the strip 2 and pushed the same down against the cams so that the strip is firm against die pad surface 9*a*. This action causes the solder to enter the cradle 44. The cradle completely surrounds the solder and is relieved so as to accommodate the mounting section 26.

With further down motion of the punch pad bolster, an appropriately shaped tool 45 strikes and envelopes the solder and completes the wrapping operation as shown at 35*c* in part (c). When the punch pad bolster moves to the return position, the tool 45 and stripper 43 move away and the cams raise the strip so that the solder is extracted from the cradle. The strip is now ready for working by the punches 16.

The operation of the solder feed machine 22 will be explained in connection with FIG. 6. As described heretofore, the feeder 22 places segments of solder in position to be cut and wrapped.

The solder is injected into the cut/wrap position on the bottom of the body strip 2 and for this purpose the feeder 22 is located beneath die pad 9. Access is provided in the bolster 8 and pad 9 to accommodate the top end of the feeder and the solder going into the insert of guide 40. The feeder is oriented with its axis inclined approximately 15° to the die pad surface and extends in sidewise at approximately a 30° angle to the vertical.

The feeder 22 comprises a stationary support tube 50 slidably mounting a solder strip gripper 51 which is actuated by a driver 52 as a function of the reciprocating motion of the punch pad bolster.

When the punch pad bolster goes up in the return stroke, the driver 52 moves the gripper 51 which grips and moves the solder into the cut/wrap position as noted for the segment 35 in FIG. 4(a). When the punch pad bolster goes into working stroke (to cut and wrap the segment) the driver 52 moves the gripper 51 to re-set condition where it is ready to move and position another segment upon the return stroke of the punch pad bolster. How the incremental solder feed is accomplished will be noted following.

The tube 50 is supported by bracket 53 connected to the press and held in position by clamp 54.

The tube receives the solder strip 34 from roll 55. The strip extends up thru and out of the tube to the guide 40 as indicated by the dotted lines 34*a*.

The tube 50 slidably mounts the gripper 51. The head 56 of the gripper is in the form of a collet which functions to grip and ungrip the solder strip.

The gripper 51 slidably mounts the driver 52. Also the driver is slidably supported by bearing 57 on the bracket 53.

The left hand end of the driver has an annular slot 60 which receives a yoke 61. The yoke is directly connected to the punch pad bolster 11 and the yoke moves the driver 52 back and forth in synchronism with the motion of the punch pad bolster.

The driver 52 moves the gripper 51 as follows. The right hand end of the driver has an annular tapered drive surface 62 which, when the driver is moved to the right, engages a similar tapered surface 63 on the gripper 51 and moves the same to the right. When the driver moves to the left it engages a snap ring 64 on the gripper and moves the same to the left.

It will be apparent that if the yoke 61 is moved in a vertical direction, the upstroke will cause the driver 52 to move to the right and effect engagement of the surfaces 62 and 63. This causes the fingers of the collet 56 to move inwardly and grip the solder strip and push the same thru the guide 40 so that the segment 35 is positioned for cutting and wrapping as previously explained.

The yoke being directly connected to the punch pad bolster will move up with the same until the bolster is in its fully up or return position. At this point the forward movement of the gripper stops and the solder is properly positioned.

On the working stroke of the punch pad bolster, the yoke moves downwardly and starts to move the driver 52 to the left. The surface 62 on the driver disengages from the surface 63 on the gripper and immediately the collet 56 on the gripper releases its grip on the solder. With further down motion of the yoke, the driver contacts the snap ring 64 and moves the gripper to the left. At the full working stroke of the punch pad bolster, the gripper has been moved to its re-set position wherein it is ready again to be moved to grip the solder strip and push the same through the guide 40 when the punch pad bolster goes through the return stroke.

The method and feeder 22 have been described in connection with the solder being fed in from the bottom. It will be understood that in some contacts it may be more convenient to position the solder segment on the top of the mounting section and to cut and wrap from that position.

With respect to the representations of the various punches and dies or tools shown in the drawings it will be understood that the actual physical structure is not detailed as the same will be readily apparent to those skilled in the art particularly upon being appraised of the type of operations and the results desired in performing the various steps and such structure may vary depending on the nature of the contact.

To summarize the foregoing description, contacts with a solder band or mass attached are formed and discharged out of the press one following the other in uninterrupted succession and without handling and with the precise amount of solder secured in the desired position.

I claim:

1. In a method of consecutively forming electrical contacts from at least one metal strip worked in a progressive die, which method includes providing a progressive die with its punch pad and die pad having a plurality of fabricating punch means and die means respectively spaced at fabricating stations along said axis for forming said contacts, feeder mechanism intermittently feeding the metal strip between the pads and operating said fabricating punch and die means and said feeder mechanism to consecutively form contacts, the improvement which comprises the method of providing each contact with a solder band secured thereto comprising the steps of:

providing said punch pad with a plurality of solder punch means and said die pad with a plurality of solder die means respectively spaced at solder stations along an axis and configured and movable to perform steps (a) through (d) as specified below:

providing a solder strip;

providing feed mechanism for feeding the solder strip adjacent the metal strip;

upon operation of the progressive die and at successive dwells of the metal strip perform the following steps:

(a) while an area of the metal strip is at one of said solder stations use solder punch means and die means to punch a pair of cut-outs to form a solder mounting section therebetween;

(b) while said solder mounting section is at an other of said solder stations use the solder feed mechanism to place a segment of the solder strip adjacent said mounting section;

(c) while said solder mounting section and said solder segment are maintained at said other solder station, use solder punch and die means to cut said solder segment so that portions thereof respectively extend outwardly on opposite sides of said mounting section;

(d) while said mounting section and cut solder are maintained at said other solder station use solder punch and die means to wrap said outwardly extending portions over said mounting section so the solder is self-secured thereto; and repeat steps (a) through (d) on the body strip and solder strip until said steps being simultaneously performed and continue said simultaneous operation to consecutively provide contacts with a solder band.

2. The method of claim 1 further including the step, performed when said mounting section and the solder secured thereto are at another of said solder stations, of using solder punch and die means to completely wrap the solder around the mounting section.

3. In a method of consecutively forming electrical contacts from at least one metal strip worked in a progresive die, which method includes providing a progressive die with its punch pad and die pad having a plurality of fabricating punch means and die means respectively spaced at fabricating stations along said axis for forming said contacts, feeder mechanism intermittently feeding the metal strip between the pads and operating said fabricating punch and die means and said feeder mechanism to consecutively form contacts, the improvement which comprises the method of providing each said contact with a solder mass secured thereto comprising the steps of:

providing said punch pad with a plurality of solder punch means and said die pad with a plurality of solder die means respectively spaced at solder stations along an axis and configured and movable to perform steps (a) through (d) as specified below;

providing a solder strip;

providing feed mechanism for feeding the solder strip adjacent the metal strip;

upon operation of the progressive die and at successive dwells of the metal strip perform the following steps:

while an area of the metal strip is at one of said solder stations use solder punch means and die means to form a solder mounting section:

(b) while said solder mounting section is at an other of said solder mounting stations use the solder feed mechanism to place a segment of the solder strip adjacent said mounting section;

(c) while said solder mounting section and said solder segment are maintained at said other solder station use solder punch and die means to cut said solder segment;

(d) while said mounting section and cut solder are maintained at said other solder station use solder punch and die means to press the solder against said mounting section and deform the solder over the section so that the solder secures itself to the mounting section.

repeat steps (a) through (d) on the body strip and solder strip until said steps being simultaneously performed and continue said simultaneous operation to consecutively provide contacts with a solder mass.

4. The method of providing electrical contacts each with a solder band secured thereto comprising the steps of:

providing a strip having a plurality of at least partially formed electrical contacts each with a solder mounting section;

providing a solder strip;

sequentially moving said strip so that said mounting section sequentially occupies one of a plurality of positions serially spaced along an axis at a preselected positions perform the following operations for each such contact;

(a) while said mounting section is at one of said positions locate a segment of the solder strip adjacent said mounting section;

(b) while said mounting section and solder segment are maintained in said one position cut said segment so that portions extend respectively outwardly on opposite sides of said mounting section;

(c) while said mounting section and the cut solder segment are maintained in said one position at least partially wrap the cut solder over said mounting section so that the solder secures itself to the mounting section; and repeating said steps (a) through (c) until the steps are being simultaneously performed and continue said simultaneous operation to consecutively provide contacts with a solder band.

5. The method of providing electrical contacts each with a solder band secured thereto comprising the steps of:

providing a strip having a plurality of at least partially formed electrical contacts each with a solder mounting section;

providing a solder strip;

sequentially moving said strip so that said mounting section sequentially occupies one of a plurality of positions serially spaced along an axis at preselected positions perform the following operations for each such contact;

(a) while said mounting section is at one of said positions locate a segment of the solder strip adjacent said mounting section;

(b) while said mounting section and solder segment are maintained in said one position cut said segment so that portions extend respectively outwardly on opposite sides of said mounting section;

(c) while said mounting section and the cut solder segment are maintained in said one position at least partially wrap the cut solder over said mounting section so that the solder secures itself to the mounting section;

(d) while maintaining said wrapped condition move the strip to position said mounting section and wrapped solder at another of said positions and then completely wrap the solder around the mounting section; and repeating said steps (a) through (d) until the steps are being simultaneously performed and continue said simultaneous operation to consecutively provide contacts with a solder band.

* * * * *